US008696318B2

(12) United States Patent
Rolla

(10) Patent No.: US 8,696,318 B2
(45) Date of Patent: Apr. 15, 2014

(54) STEPPED SURFACE PROPELLER

(75) Inventor: Philip Rolla, Bruzella (CH)

(73) Assignee: Twin Disc, Inc., Racine, WI (US)

( * ) Notice: Subject to any disclaimer, the term of this patent is extended or adjusted under 35 U.S.C. 154(b) by 814 days.

(21) Appl. No.: 12/718,703

(22) Filed: Mar. 5, 2010

(65) Prior Publication Data

US 2011/0217177 A1 Sep. 8, 2011

(51) Int. Cl.
*B63H 1/26* (2006.01)
*F03B 3/12* (2006.01)

(52) U.S. Cl.
USPC ..... 416/228; 416/236 R; 416/235

(58) Field of Classification Search
USPC ..... 416/62, 197 R, 228, 235, 236 A, 236 R, 416/237; 440/49
See application file for complete search history.

(56) References Cited

U.S. PATENT DOCUMENTS

| | | | | |
|---|---|---|---|---|
| 1,531,967 | A * | 3/1925 | Macmillan | 416/236 R |
| 2,990,889 | A * | 7/1961 | Welch | 416/62 |
| 4,373,241 | A | 2/1983 | Maloof | |
| 4,865,520 | A * | 9/1989 | Hetzel et al. | 416/236 R |
| 5,114,313 | A * | 5/1992 | Vorus | 416/93 A |
| 6,390,776 | B1 * | 5/2002 | Gruenwald | 416/203 |
| 6,699,016 | B1 * | 3/2004 | Dean | 416/235 |
| 7,278,825 | B2 * | 10/2007 | Segota et al. | 416/62 |
| 2011/0091328 | A1 * | 4/2011 | Powers | 416/236 R |

FOREIGN PATENT DOCUMENTS

| | | |
|---|---|---|
| JP | 6037196 | 5/1994 |
| JP | 07-323886 | 12/1995 |
| JP | 2002513717 | 5/2002 |
| KR | 100923533 | 10/2009 |
| RU | 2096258 | * 11/1997 |
| WO | 92/06000 | 4/1992 |
| WO | 2008/095259 | 8/2008 |

* cited by examiner

*Primary Examiner* — Edward Look
*Assistant Examiner* — Jason Davis
(74) *Attorney, Agent, or Firm* — Boyle Fredrickson, S.C.

(57) ABSTRACT

A marine surface propeller, and blade therefore, which is surface piercing and partially submerged, and includes a blade geometry that improves distribution of pressure and control to wetted and ventilated regions. Preferably, the feature has a positive step (ramp, cup, interceptor, indent or other geometric addition or intervention) between one fifth and four fifths chord length so as to create a high pressure peak or zone in what is now a low pressure zone on either the blade face or back or both and to create speed controllable wetted and ventilated regions.

17 Claims, 10 Drawing Sheets

STEPPED SURFACE PROPELLER

BACKGROUND OF THE INVENTION

1. Field of the Invention

The surface propeller or surface piercing propeller is a partially submerged naturally ventilated propeller that during normal forward movement of the marine vessel achieves all of its thrust from blade face pressure because the blade back is nearly or completely ventilated. Based on this functionality the blade front (or blade face) may be referred to as the pressure face and the blade back as the vacuum face.

2. Description of the Related Art

The function of a surface propeller is based upon basic principles which have been generally accepted for many decades. Application of the basic principles to actual operating conditions, however, involves the interplay of many complex variables caused by the three dimensional complex blade face surfaces of the propeller. Consequently, the effective functioning of a propeller blade, although theoretically simple, is actually extremely complex, especially at high operational speeds, as is well known to those in this art. Therefore surface propeller designers constantly experiment with propeller variations and periodically discover blade geometries that empirically function unexpectedly well, or unexpectedly poorly, for reasons that are not fully understood.

Achieving improvements in blade geometries occurs after long periods of trial and error experimentation with different configuration variations. Those skilled in the art have in the past, by the above described process, experimented, developed and successfully applied various features to the marine surface propeller trailing edge to increase thrusting efficiency using geometric structures such as the cup, ramp or interceptor.

Effective performance of the surface piercing propeller during forward movement depends upon obtaining pressure on the front face of the propeller, which results in the propeller's thrust. The back side of the propeller, the vacuum side, is in a void or cavity which is naturally ventilated from the surface air, and so provides substantially no pressure either positive or negative. Thus, effective performance also depends on minimizing pressure on a blade back.

In order to maximize blade face pressure almost all known surface propellers existing today have a geometry consisting of a flat or cambered pressure face with an annex at the trailing edge which can be a ramp, cup, interceptor or any geometric addition at the trailing edge to create a pressure peak at this point. This results in surface propellers having a pressure peak at the leading edge and a second pressure peak at the trailing edge. However, the central portion of the blade face chord is a low pressure zone between these two pressure peaks, which fails to maximize the pressure on the blade face.

Thus, current surface piercing propeller blades fail to maximize their thrust for a given rotational velocity (RPM) and size (effective radius or surface area). In addition, there are no known features for the back side of a surface propeller directed toward minimizing pressure.

Because prior art surface propeller blades fail to provide a solution to the problem of providing a highly efficient and compact propeller blade then what is needed is a surface piercing propeller blade that maximizes the thrusting force by maximizing pressure for a given area on the blade pressure face and minimizing the pressure for a given area on the blade vacuum face.

SUMMARY OF THE INVENTION

This invention relates to marine surface propellers and more particularly to a surface piercing propeller. The present invention provides an improved propeller blade for a multi-bladed surface piercing marine propeller by adding a geometric feature called a "step," which is a raised surface of a specific type and placement, on either the blade front face, the blade back, or both surfaces. The surface piercing propeller blade of the current invention, controls the pressure and water flow over the blade face and/or blade back thereby increasing the thrusting force among other advantages. The surface piercing propeller blade of the current invention, however, controls the pressure and water flow over the blade face and/or blade back thereby increasing the total thrusting force among other advantages. This force also produces drag such that another advantage of this invention is achieving maximum lift with minimum drag.

A major component of thrust is produced by the complex turning of water flow over the blade pressure face. Surface propellers existing today have a pressure face geometry that is flat or cambered with an annex at the trailing edge thereby creating pressure peaks nearby the leading and trailing blade edges. The central portion of the blade generally has a low pressure zone. The addition of a geometric step feature on the blade face between the leading and trailing edges increases the pressure near this feature and increases the overall pressure (blade pressure face loading) thereby increasing thrusting force.

Therefore one aspect of this invention comprises a positive step on the blade face which can be a ramp, cup, interceptor or other geometric annex, addition or intervention. The positive step is a structure that rises in a positive direction from the local surface, i.e. a surface which is near to the structure, when traversing the blade surface in a given manner, wherein positive is defined by the local surface normal directed away from the surface. The step feature is located at between one fifth and four fifths of the chord length, i.e. mid-chord, (wherein a chord is an imaginary straight line connecting leading and trailing edges of a curved or non-planar blade surface) so as to create a high pressure peak or zone in what is now a low pressure zone. This step will more equally distribute pressure over the blade face and result in a higher blade face loading. This will allow the use of smaller diameters and thus a higher pitch diameter ratio propeller and its subsequent higher efficiency.

This positive pressure face step can be designed so as to have another positive efficiency benefit: as the propeller moves into high RPM and speed ranges the second step of the blade face would enter into a ventilated cavity, reducing the effective wetted blade area thereby improving efficiency.

One main object of the invention is to provide such a specifically configured marine propeller blade that will more equally distribute pressure over the blade face and result in a higher blade face loading, thus allowing the use of smaller diameters and thus higher pitch diameter ratios and subsequent higher propeller efficiencies. Smaller diameters will also result in lower production costs.

It is another object of this invention to improve efficiency at higher speeds. The geometry of this invention can be configured so that as the propeller moves into higher RPM/speed ranges the blade face between the positive step and the trailing edge enters into a naturally ventilated cavity (the same as the blade back), thus reducing the effective blade working area and increasing maximum efficiency.

Accordingly, the propeller of the present invention overcomes the inefficient low pressure central portion of the blade face, experienced with the prior art, by providing propeller blades capable of generating high pressure and, thus, increased thrust on the central portion of the blade face chord.

The propeller of the present invention also improves efficiency by decreasing the effective blade face surface area at higher RPMs.

Improved thrusting efficiency allows the use of smaller diameters to achieve needed thrust and thus a higher pitch diameter ratio propeller. The smaller diameters made possible by this invention will also allow easier and more flexible installation, lower draft for operation in shallow waters, and many other benefits.

A major factor in the total thrust produced by the blade is the absence of a thrusting force on the vacuum back side that would otherwise counteract the force on the front pressure face. Surface propellers existing today have a vacuum face geometry that is outwardly curved or convex. The simplest blade performance analysis neglects any pressure from the back side equating it to zero by assuming that the back is completely ventilated with a much lower vapor pressure. However, surface blade tunnel testing indicates that at very low advance ratios there is generally natural ventilation of the propeller blade back section along with partial fluid adhesion from the propeller's leading edge over an unstable region that ends at about one half chord length. This partial adhesion provides added lift and higher efficiency at lower advance ratios up to the advance speed which causes the entire blade back to be ventilated.

The addition of a negative step, seen as a step down with respect to the water flow direction, provides a defined and stable area of water adhesion up to a certain advanced speed, giving a positive area for natural ventilation to occur up to the advance speed whereupon the complete blade back would become ventilated. This also allows the phenomenon of partial water adhesion on the blade back at low advance speeds to be stable and more predictable.

Accordingly, it is one object of the current invention to provide a more efficient and predictable dual or bimodal operation of the surface propeller by utilizing a negative step on the blade vacuum side.

Therefore one aspect of this invention comprises a negative step on the blade back which can be a ramp, cup, interceptor or other geometric addition or intervention, which is located at between one fifth and four fifths of the chord length (mid-chord) so as to create a controllable zone of partial water adhesion.

Yet another object of the negative vacuum face step is to improve reverse thrusting efficiency when the propeller rotation direction is reversed. In reverse mode, the direction of the water flow is reversed, and the geometric feature acts as a positive step of the pressure face and the roles of the blade face and blade back are reversed such that the blade face becomes the vacuum face and the blade back becomes the pressure face. This reverse rotation creates an additional pressure peak along the blade back, increasing the overall pressure and, thereby, increasing efficiency and reverse thrusting force.

Whether using the step feature on the back, front, or both sides of a surface propeller blade, certain efficiencies are realized based upon the propeller's speed and direction.

The propeller blade of the present invention overcomes the inefficient low pressure central portion of the blade front face or back experienced with the prior art in both forward and reverse modes, allows for more efficient operation at both higher and lower speeds, and provides for a more predictable bimodal operation by controlling the ventilation and water adhesion to the blade back and front. The invention would be applicable to all marine surface propellers regardless of geometry, blade number, hub configuration, material, and so forth.

According to one aspect of the preferred embodiments, a blade of a surface piercing propeller for a marine craft includes a blade root securably attached to a propeller hub. The blade also includes a blade tip distal to the blade root, a blade face and an opposing blade back. A tapered leading edge and a trailing edge, wherein the leading edge is narrower than the opposing trailing edge, is also provided. Finally, the blade includes a trailing edge step feature on the blade face, and at least one geometric feature on either the blade back, the blade face, or both faces that is located substantially mid-chord.

In another aspect of the invention, a surface piercing propeller for a marine craft surface drive, including a'plurality of blades securably attached to a central propeller hub, includes a blade having a blade root securably attached to the propeller hub, and a blade tip distal to the blade root. Two major and opposing surfaces are provided: a blade back and a blade face wherein the blade face is subjected to a substantially higher pressure from a fluid than the blade back while moving forward. Two major and opposing edges are also provided: a leading edge substantially tapered, and a trailing edge which is substantially thicker than the leading edge. The blade also includes a trailing edge step feature on the blade face and substantially close to the trailing edge, and a second step feature on either the blade back or the blade face. In this case, the step features are located on the blade surface between the leading edge and the trailing edge, extending in a direction from the blade root to the blade tip, and rising from a local surface when traversing the blade surface from the leading edge to the trailing edge or from the trailing edge to the leading edge.

According to another preferred embodiment, a blade of a surface piercing propeller for a marine craft includes a blade root securably attached to a propeller hub and configured to move a volume of water when rotated thereby producing a thrust. A blade face and an opposing blade back are also provided, wherein one of the blade face and blade back is subjected to a substantially higher pressure from the volume of water than the opposing surface thereby producing a increased force to move the marine craft. A tapered leading edge is provided and configured to enter the water first when the propeller is rotating to move the marine craft forward, and an opposing trailing edge that is substantially thicker than the leading edge, and having a first geometric feature on the trailing edge blade face surface that creates a fluid pressure peak nearby thereby producing substantially more force to move the marine craft forward. Finally, the blade includes a second geometric feature on either the blade back or the blade face that is located substantially mid-chord, wherein the second geometric feature creates a nearby fluid pressure peak thereby producing more force to move the marine craft.

According to yet another aspect of this embodiment, a third geometric feature is disposed on the one of the blade back and the blade face that does not include the second geometric feature. The third geometric feature creates a fluid pressure peak thereby producing substantially more force to move the marine craft.

The described aspects and objects of the present invention will be better appreciated and understood when considered in conjunction with the following description and the accompanying drawings. It should be understood, however, that the following description while indicating preferred embodiments of the present invention is given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
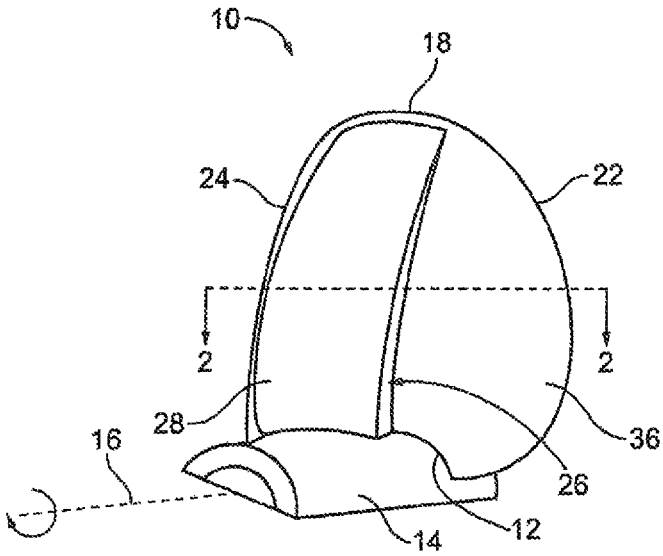
FIG. 1 is a perspective view of a first embodiment of the marine surface piercing propeller blade of the present invention.

With reference now to the drawings, and particularly to FIG. 1, there is shown a first embodiment of the surface propeller blade 10 of the preferred embodiments. The blade 10 has a blade root 12 securably attached to a propeller hub 14 which rotates about a propeller axis 16. Given that the thrust on a surface propeller is generated by the blade face 36 accelerating the mass of water it is confronting (Newton's second law) then the water exerts an equal but opposite force forward on the blade face (Newton's third law). The force produced by the deflected volume of water is the thrust (or lift), which moves the marine vehicle in the forward direction as shown in FIG. 1. Although only one propeller blade 10 is depicted, a propeller formed of such blades will normally have a plurality of blades, for example, three or more.

With further reference to FIG. 1, the surface propeller blade 10, has a root 12 and a tip 18 distal from the blade root 12. The blade 10 comprises a leading edge 22 and a trailing edge 24, so designated because the leading edge 22 enters the water before the trailing edge 24 during normal forward travel of the marine vessel with the direction of rotation as shown on FIG. 1.

The blade 10 also has a front face (or pressure face) 36 having a first geometric feature 26, referred to as a step, and a trailing edge step feature, a second geometric feature 28 near the trailing edge 24, which can be referred to as a step, but is more often referred to by those with skill in the art, depending upon the geometry, as a cup, a ramp, an indent, an annex, an addition, an intervention, or an interceptor. Examples of such geometric features can be found, for example, at U.S. Pat. No. 4,865,520 to Brunswick Corp.; "Everything You Need To Know About Propellers", Mercury Marine Division, Brunswick Corporation, 1984, QS5-384-10M, Part No. 90-86144, and "Design, Manufacture and Full Scale Trial of High Performance Surface Piercing Propeller", Hwang et al., WELWYNDMARINE.com (1999), the disclosures of which are expressly incorporated by reference herein. The preferred embodiment of FIG. 1 shows the geometric feature 28 as a cup.

The surface piercing propeller blade 10 of the preferred embodiment provides benefits over the prior art by the addition of the geometric feature, step 26, shown as a positive step that rises upwardly from the blade face when traversing the face from leading edge 22 to trailing edge 24 (the direction of water flow when the propeller is rotating to move the marine vehicle forward). As shown in FIG. 1, in one preferred embodiment, the step feature 26 extends substantially along the length of the blade 10 from root 12 to tip 18 and is substantially parallel to the trailing edge 24. Further, the embodiment of FIG. 1 has a step height that decreases from the blade root 12 to tip 18 as shown.

Figure 2:
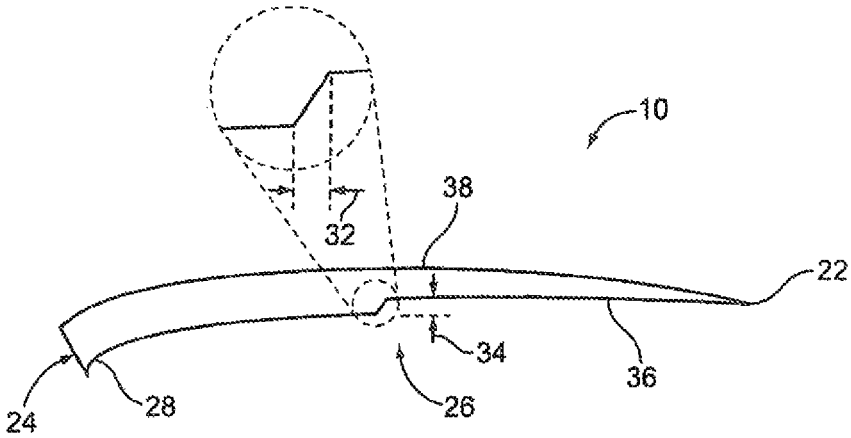
FIG. 2 is a sectional top view of the surface piercing propeller blade of the embodiment of FIG. 1. with a step on the blade face.
Figure 3:
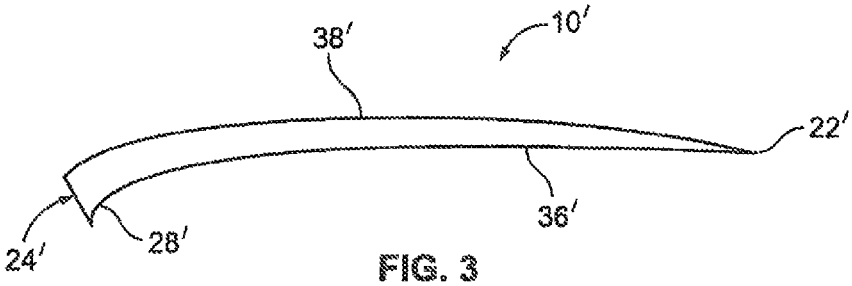
FIG. 3 Prior Art
FIG. 3 is a sectional top view of a typical prior art surface piercing propeller blade.

The cross section 2-2 from FIG. 1 is shown in FIG. 2, while a similar cross section for a known surface piercing propeller blade lacking the step feature is shown in FIG. 3. Both FIGS. 2 and 3 show the step section having a cambered or concave front or pressure face 36, 36', a convex back or vacuum face 38, 38', and a trailing edge cup 28, 28'. In addition, both cross sections show a narrow leading edge 22, 22' which widens to a thicker trailing edge 24, 24'. FIG. 2 also depicts the cross sectional shape of the step 26 shown in FIG. 1, including the step's transition region (or width) 32 and the step's height 34. Note that the front face 36 is the drive or pressure face when the marine vehicle is moving forward, while the back face 38 is the drive face when the marine vehicle is moving in reverse, as shown in FIG. 1. Herein, the terms pressure face and vacuum face are used interchangeably when the blade is driving in the reverse direction such that the front face may become the vacuum face and the blade back becomes the pressure face.

FIG. 3 shows a typical surface propeller blade chord section, which is the state of the art today as to cross-sectional geometry. This blade profile is especially suitable for surface piercing conditions wherein the back 38' is contained within a naturally surface ventilated envelope while rotating, and the pressure surface 36' is wetted to give pressure and thrust.

Figure 4:
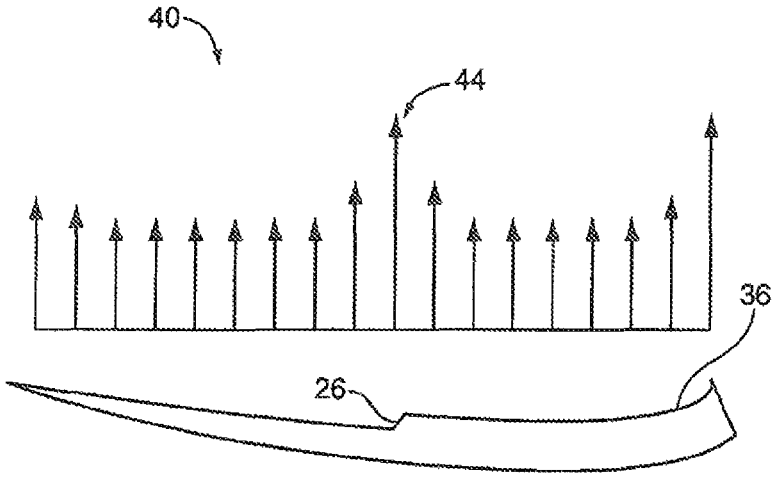
FIG. 4 is a sectional top view of an embodiment of the blade of the present invention with a pressure vector diagram showing pressure vectors along the blade frame's face.
Figure 5:
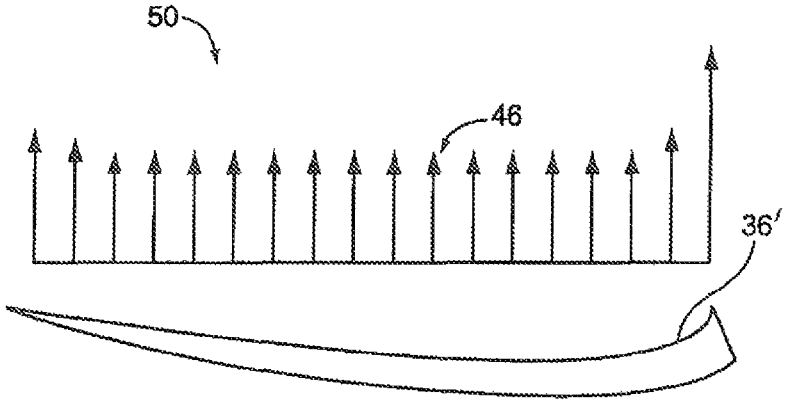
FIG. 5 Prior Art
FIG. 5 is a sectional top view of a typical prior art surface piercing propeller blade with an accompanying pressure vector diagram showing pressure vectors along the blade face.

However, the typical surface propeller pressure of the prior art does not maximize the force on the pressure surface as shown by comparing FIGS. 4 and 5. The cross section of FIG. 4 shows the pressure face step 26 of a preferred embodiment and the resultant pressure vector diagram 40 along the pressure face 36. The pressure is increased around the step 26 as indicated by pressure vectors substantially near the step 26, peaking with pressure vector 44. Alternatively, the pressure vector diagram 46 of FIG. 5, the known surface piercing blade, shows less pressure in the central region of the pressure vector diagram 46. Accordingly, this preferred embodiment increases pressure, which results in increased thrust, with the positive step 26. Notably, the overall thrust of the propeller will be the power put into it multiplied by its efficiency. In one preferred embodiment the thrust from the step 26 typically will be at least 30 percent of overall thrust depending on height 34, and the portions of the propeller faces (front and rear) that are working. The step 26 at high speed, with the rear portion 38 of blade 10 ventilated, could produce up to 70% of overall thrust. The increased efficiency resulting from the step 26 may be 2% or 3% in fully wetted face operation and 3% to 5% in high speed operation (50% of the face wetted), yielding a potential thrust increase of 4% to 8%.

In the end, the step 26 operates to redistribute the pressure diagram on the face of the propeller and, allows, for example, 30% more thrust per area (e.g., when fully wetted), the step allows a 10% smaller diameter. Again, this could mean 2 or 3% increase in efficiency in fully wetted face mode and 3 to 5% in high speed (50% face wetted) mode, and a subsequent increase in thrust from an increase in efficiency, typically about 4 to 8%. Moreover, regarding the increased thrust from wetted surface adhesion on the back face, this would based on lift through the Bernoulli effect over this convex surface.

Figure 6:
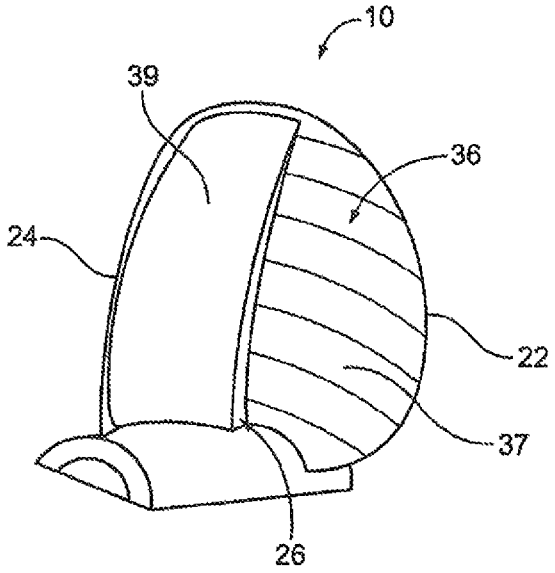
FIG. 6 is a perspective view of a preferred embodiment of the propeller blade of the present invention showing wetted and ventilated pressure surface areas.

Referring next to FIG. 6, it is another object of the preferred embodiments to improve blade efficiency at higher speeds. Lower speed operation of the blade results in nearly all of the blade face 36 being wetted. However, while moving at higher speeds the step feature 26 may be configured to create a naturally ventilated cavity 39 on the trailing edge portion of the blade face 36 (between positive step 26 and the trailing edge 24) and a wetted surface 37 of the leading edge portion of the blade face 36 (shown as cross-hatched), thus reducing the effective blade working area thereby maximizing efficiency. For example, in one embodiment, a reduction in blade area between thirty and fifty percent provides an approximate gain in propeller efficiency of three to five percent. Preferably, the size of the cavity 39 should be sufficient to envelope the unwetted area, but also be the smallest possible cavity that does this properly. By doing so, the propeller typically achieves the highest efficiency improvements given that it takes less energy to create.

Figure 7:
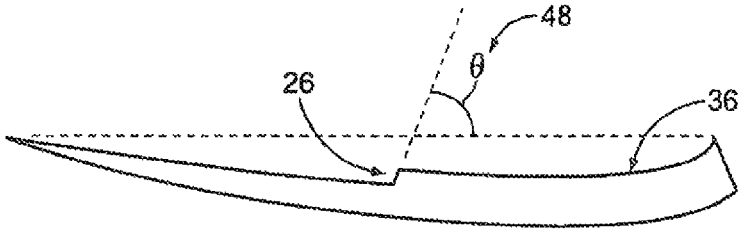
FIG. 7 is a sectional top view of an embodiment of the blade of the present invention showing the relative angle of the step transition region.

Turning to FIG. 7, the step 26 preferably has a given angle, theta 48 measured with respect to the propeller axis. In one preferred embodiment, the angle 48 can be as low as sixty degrees. In another preferred embodiment, the angle 48 can be as large as 135 degrees. For instance, the angle for a blade with 30 degrees of aft blade rake (i.e., 30 degrees tilted aft of a perpendicular from the propeller hub's central axis) and also 30 degrees of aft blade skew (i.e. 30 degrees of curve toward aft across blade main axis), are a possible 135 degrees in the rear mode (operating to propel the marine vehicle in reverse), and no less than 60 degrees in the forward mode.

Figure 8:
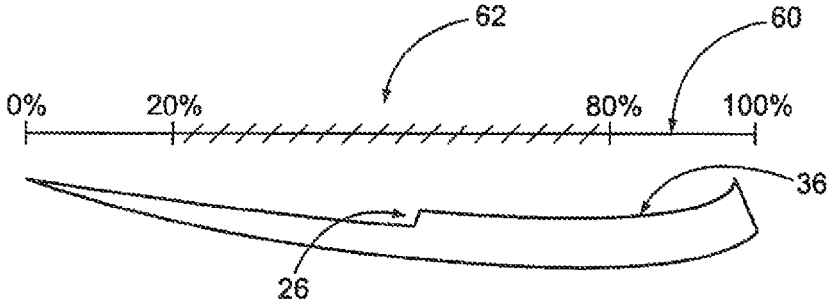
FIG. 8 is a sectional top view of an embodiment of the blade of the present invention showing the region along the chord length where the step feature may be located.

Turning to FIG. 8, the step feature may be positioned in a range of 20% to 80% along the chord length of the pressure face 36 as shown by the shaded region 62 of the ruled chord 60. In one embodiment, the step 26 is close to the mid-point of the chord as shown in FIG. 7. In another embodiment, the step feature 26 is substantially at the 20% point of the chord. In yet another preferred embodiment, the step feature 26 is substantially at the 80% point of the chord. The height 34 of the step 26 on the face 36 could be from about 0.5% to 6% of the chord length.

Figure 9:
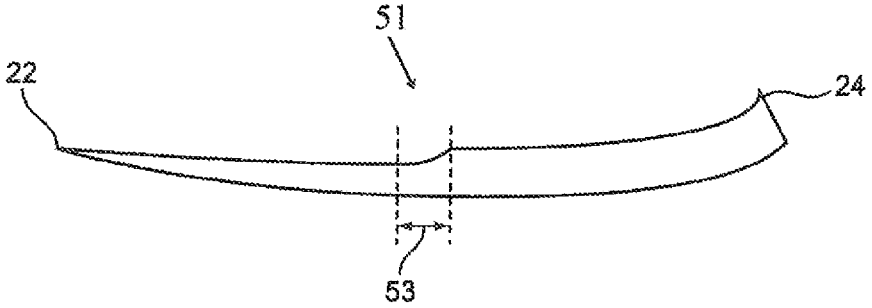
FIG. 9 is a sectional top view of another embodiment of the blade face step feature.
Figure 10A:
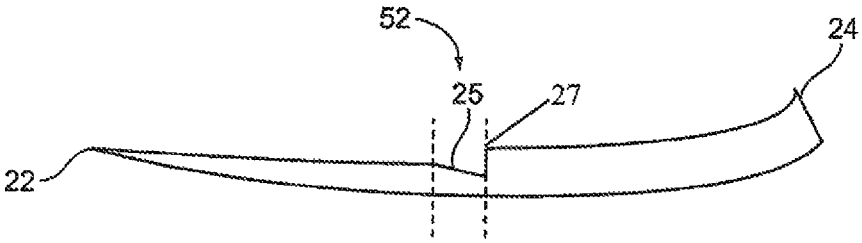
FIG. 10A is a sectional top view of yet another embodiment of the blade face step feature.
Figure 10B:
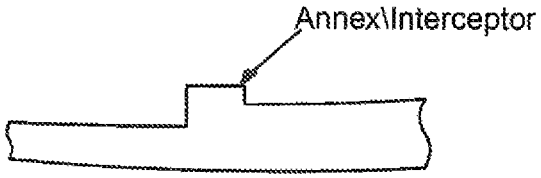
FIGS. 10B-M are enlarged partial sectional top views of various embodiments of the front face step feature.
Figure 10C:
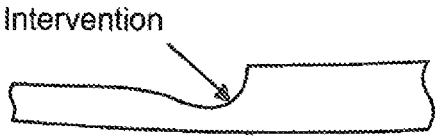
Figure 10D:
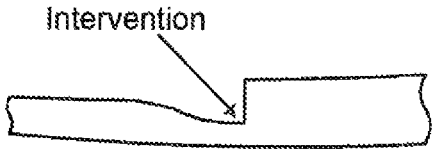
Figure 10E:
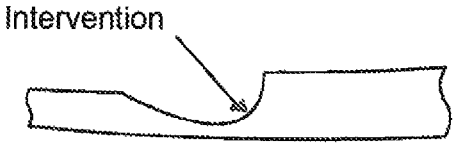
Figure 10F:
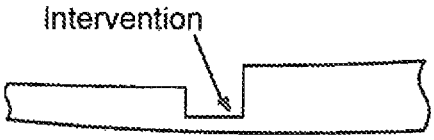
Figure 10G:
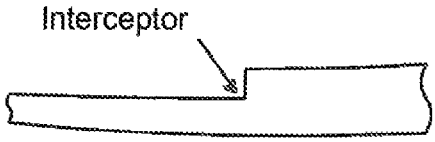
Figure 10H:
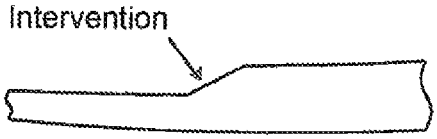
Figure 10I:
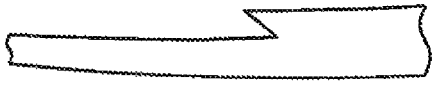
Figure 10J:
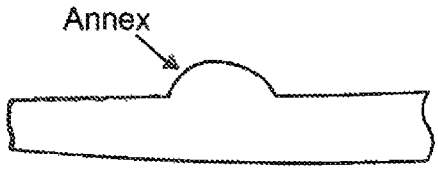
Figure 10K:
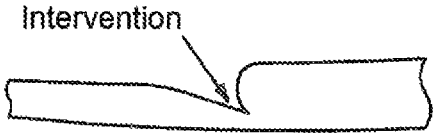
Figure 10L:
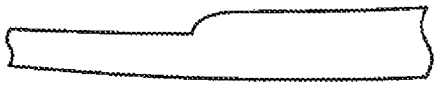
Figure 10M:
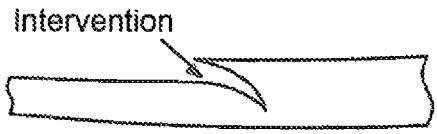

There are many possible variations on the pressure face step geometry. The common element is a feature that rises from the local surface as the face is traversed from the leading edge 22 to the trailing edge 24. Possible variations are shown in FIGS. 9 and 10A-K. In the embodiment of FIG. 9, the step transition is shown as a concave curve 51 rather than a straight line. The concave curve distinguishes itself from the surrounding curved surface by having an area that rises from the local surface because of a smaller radius of curvature than the surrounding area. The concave curve results in a faster positive rate of change of slope over the step width transition region 53, resulting in an increased pressure zone in proximity to the curve 50 thereby providing an increased thrust. In one embodiment, thrust could be up to 30% more than a propeller without the step 26, allowing overall diameter reduction and subsequent increased efficiency of the propeller 10 which would result in an actual effective thrust increase of 4% to 8%.

In some embodiments, the feature may have a notch, depression, or otherwise lower local surface substantially just before the rising portion. For example, in the embodiment of FIG. 10A, the step feature 52 has a leading edge that is shown as a straight segment 25 with more negative slope that precedes the positive step segment 27, resulting in an increased pressure zone in proximity to the step 52 thereby providing an increased thrust.

There are many other possible variations that are not shown that lie within the scope of the disclosure, which all have the common required element of the step feature: a positive step 26 rising from the local pressure face 36 when traversing the surface from the leading edge 22 to the trailing edge 24. Alternatively, this positive or rising 'step' can be characterized as having a region of increasing slope with the pressure surface as oriented, for example, as in FIG. 8 where slope is computed as rise (in this case going upwards or positive) over run (in this case going right or positive).

Figure 11:
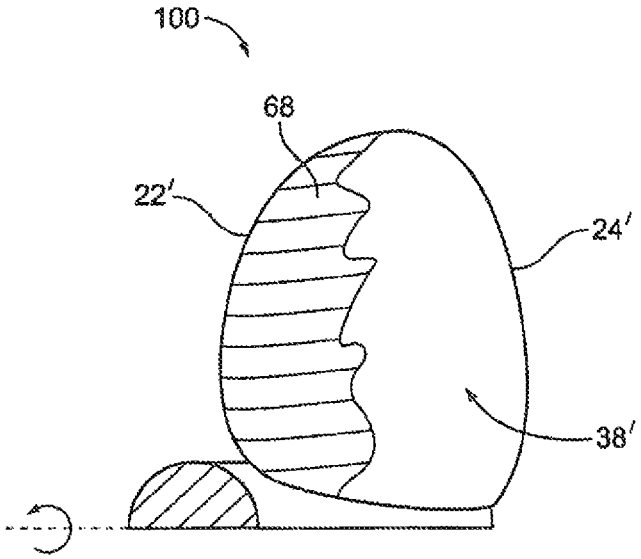
FIG. 11 Prior Art
FIG. 11 is a perspective view of a prior art propeller blade showing wetted and ventilated back surface areas.
Figure 12:
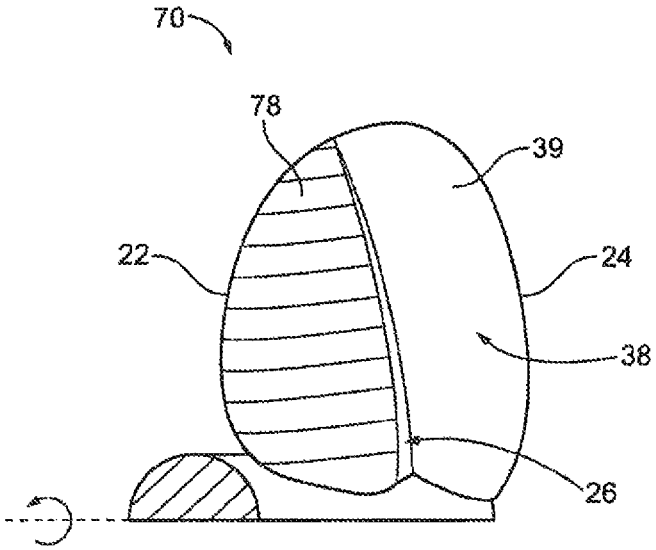
FIG. 12 is a perspective view of the propeller blade of the present invention showing wetted and ventilated back surface areas.

Referring now to FIGS. 11 and 12, it is another object of this invention to improve blade efficiency at lower speeds. Lower speed operation of a known blade 100 results a portion of the blade back 38' being wetted rather than entirely ventilated. The wetted region forms an unstable region at lower speeds. One possible wetted region is shown as shaded region 68 in FIG. 11. However, the blade of one embodiment 70 may have the step feature 26 on the blade back 38. This step 26 may be configured to create a naturally ventilated cavity 39 on the blade back (between positive step 26 and the trailing edge 24) and a fully wetted surface 78 (shown as cross-hatched) between the leading edge 22 and the step 26. The improved and predictable water adhesion at lower speeds improves blade efficiency and enables two modes of operation. The water adhesion over the convex leading segment of the chord (leading edge to step) creates a depression or suction effect (the "Bernoulli" effect) which increases the total lift in a predictable manner due to the separation point which is determined by the step 26. At a certain rate of advance, the whole blade back will ventilate and the propeller will act in the traditional surface mode with all lift coming from face pressure.

As with the step geometry of pressure face 36, there are many possible variations on the step geometry of vacuum face 38. The common element is a feature that rises from the vacuum face 38, but as the face is traversed from trailing edge 24 to the leading edge 22. Notably, this is the direction of water flow when the step feature is used to improve reverse thrust. In one embodiment, reverse thrust could be increased 50% to 80% depending on step height. The reverse thrust increase is typically in direct proportion to the step height. In one preferred embodiment, the step height on the back face could as a percentage of chord length go from 1% to 10%, depending on propeller geometry and performance parameters desired. Within physical limits, the higher the step height the greater the effect for reverse thrust. The limits are imposed by the thickness of the section. For maximum thrust efficiency, the thickness would be that which gives the needed structural integrity to the propeller, and typically no more. As a result, height would preferably stay within this thickness limitation. If reverse thrust is a sufficiently important parameter, then the section thickness and shape could be increased to increase step height at a slight loss in normal advance mode efficiency. Possible variations are shown in FIGS. 13 and 14A-O.

Figure 13:
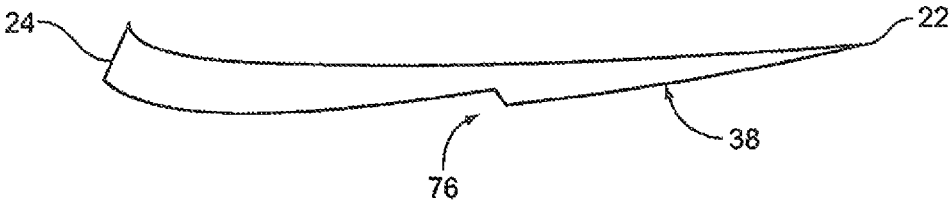
FIG. 13 is a sectional top view of an embodiment of the blade back step feature.
Figure 14A:
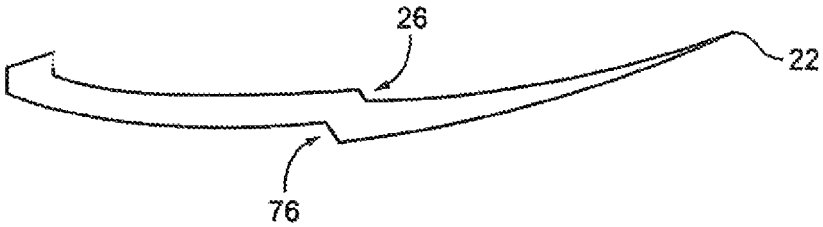
FIG. 14A is a sectional top view of yet another embodiment of the blade of the current invention showing the step feature on both the face and back of the blade.
Figure 14B:
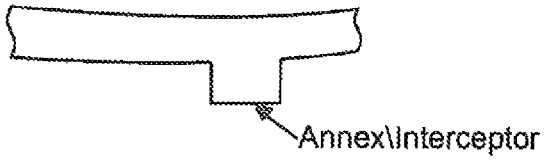
FIGS. 14B-O are enlarged partial sectional top views of various embodiments of the blade back step feature.
Figure 14C:
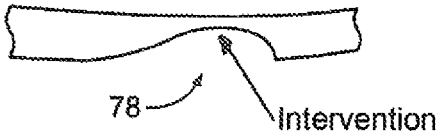
Figure 14D:
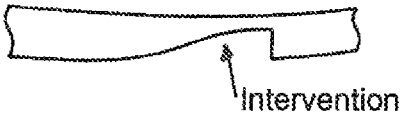
Figure 14E:
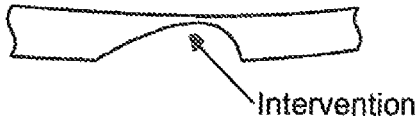
Figure 14F:
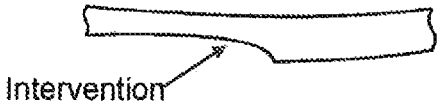
Figure 14G:
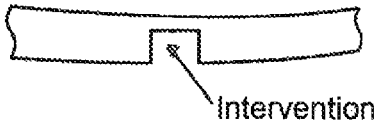
Figure 14H:
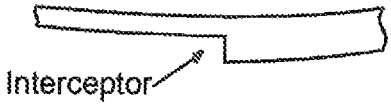
Figure 14I:
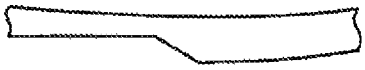
Figure 14J:
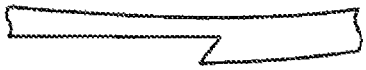
Figure 14K:
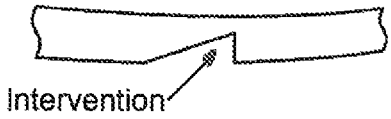
Figure 14L:
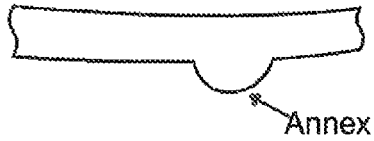
Figure 14M:
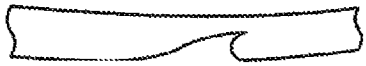
Figure 14N:
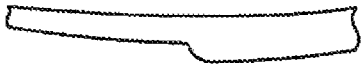
Figure 14O:
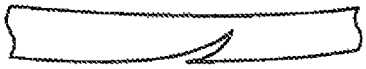

In the embodiment of FIG. 13, the step transition 76 is shown as a substantially straight segment. The variations in the shape of the step for the pressure surface 36 also apply to variations of the step for the back surface 38 with the orientation of the step 76 feature reversed with respect to the leading edge 22. In other words, there is a step up away from the local surface when going from leading edge 22 to trailing edge 24 on the pressure face 36, as opposed to a step down when traversing the blade back 38 from leading edge 22 to trailing edge 24.

As with the pressure face step geometry, in some embodiments the feature may have a notch, depression, or otherwise lower surface before the rising portion.

The front and rear step features may be combined on a single blade as shown in FIG. 14. The step feature 76 is shown on the blade back 38, and the step feature 26 is shown on the blade front 36. Note that from the leading edge 22 to the trailing edge 24 that the feature steps up on the pressure face 36, but steps down on the vacuum face 38.

Figure 15:
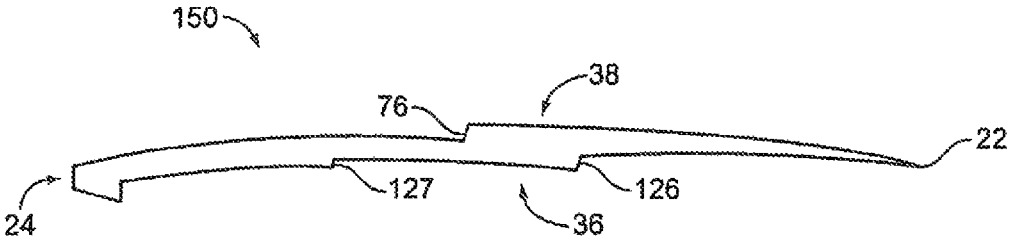
FIG. 15 is a sectional top view of an embodiment of the blade of the present invention showing two step features on the blade face and a single step feature on the blade back.

In yet another embodiment, there may be multiple step features on a given face as shown in FIG. 15. The use of multiple steps may apply to long chord sections and for certain other, or extreme, performance profiles. FIG. 15 depicts a cross-section of a blade 150 having a single step 76 feature on the vacuum face 38 and two geometric step features 126, 127 on the pressure face 36.

In one embodiment, at least one of the geometric or step features is securably attached to the propeller blade forming an assembly wherein the geometric feature is either permanently attached, removably attached, and interchangeably attached (on board). In yet another embodiment least one of the trailing edge step feature and the geometric features is integral with the blade forming a monobloc.

It is noted that many changes and modifications may be made to the present invention without departing from the spirit thereof. The scope of some of these changes is discussed above. The scope of others will become apparent from the appended claims.

What is claimed is:

1. A blade of a surface piercing propeller for a marine craft comprising:

a blade root securably attached to a propeller hub;

a blade tip distal to the blade root;

a blade face and an opposing blade back;

a tapered leading edge and an opposing trailing edge;

a trailing edge step feature on the blade face; and at least one geometric feature on either the blade back, the blade face, or both, that is located between approximately twenty percent and eighty percent of a blade chord length;

wherein the trailing edge step feature rises from a local surface of the blade face when traversing the blade face from leading edge to trailing edge; and wherein the trailing edge step feature further comprises at least one region of increasing slope when traversing a surface of the blade from leading edge to trailing edge whereby a fluid pressure peak is created substantially at or near the region of increasing slope during a rotation of the blade in a fluid.

2. The blade of claim 1, wherein the geometric feature includes a first step feature when traversing a surface of the blade from the leading edge to the trailing edge.

3. The blade of claim 2, wherein the geometric feature includes a second step feature which is on the blade back and rises from a local surface when traversing a surface of the blade from the trailing edge to the leading edge.

4. The blade of claim 3, further comprising a third step feature on one of the blade back and the blade face selected from one of a group including a cup, a ramp, an indent, an addition, an intervention, and an interceptor.

5. The blade of claim 3, wherein at least one of the geometric features is securably attached to the blade forming an assembly wherein the geometric feature is one of a group of permanently attached, removably attached, and interchangeably attached.

6. The blade of claim 2, further comprising a blade face step feature having at least one region of increasing slope when traversing the blade surface from leading edge to trailing edge whereby a fluid pressure peak is created substantially near the zone of increasing slope during a rotation of the blade in the fluid.

7. The propeller of claim 1, wherein the geometric feature includes a step on the blade back and rises from a local surface when traversing a surface of the blade from the trailing edge to the leading edge.

8. The blade of claim 7, wherein the step on the blade back includes at least one region of increasing slope when traversing a surface of the blade from trailing edge to leading edge whereby a fluid pressure peak is created substantially at or near the region of increasing slope during a reverse rotation of the blade in a fluid.

9. The blade of claim 1, wherein the trailing edge step feature is one of a group consisting of a cup, a ramp, an indent, an addition, an annex, an intervention, and an interceptor.

10. The blade of claim 1, wherein the geometric, feature is one of a group consisting of a cup, a ramp, an indent, an addition, an annex, an intervention, and an interceptor.

11. The blade of claim 1, wherein the geometric feature has a main axis extending from the blade root to blade tip which is located within an angle of about sixty to one hundred thirty-five degrees of a propeller axis.

12. The blade of claim 1, wherein at least one of the trailing edge step feature and the geometric feature is integral with the blade forming a monobloc.

13. The blade of claim 1, wherein the geometric feature is configured to create, at about the feature, at least one of a zone of controllable water adhesion and a zone of increased pressure.

14. The blade of claim 13, wherein the zone of controllable water adhesion is a. surface of the blade opposite the drive surface of the blade and is defined substantially between one of the trailing edge and leading edge, whichever enters the water first, and the geometric feature.

15. A surface piercing propeller for a marine craft surface drive comprising a plurality of blades wherein each blade is securably attached to a central propeller hub, the propeller comprising:

a blade having:

a blade root securably attached to the propeller hub;

a blade tip distal to the blade root;

two major and opposing surfaces: a blade back and a blade face wherein the blade face is subjected to a higher pressure from a fluid than the blade back while moving forward;

two major and opposing edges: a tapered leading edge, and a trailing edge which is thicker than the leading edge;

a trailing edge step feature on the blade face and at about the trailing edge;

a second step feature on either the blade back or the blade face; and wherein the step features are located on the blade surface between the leading edge and the trailing edge, extending in a direction from the blade root to the blade tip, and rising from a local surface when traversing the blade surface from the leading edge to the trailing edge or from the trailing edge to the leading edge; and wherein the trailing edge step feature further comprises at least one region of increasing slope when traversing a surface of the blade from leading edge to trailing edge whereby a fluid pressure peak is created substantially at or near the region of increasing slope during a rotation of the blade in a fluid.

16. A blade of a surface piercing propeller for a marine craft comprising;

a blade root securably attached to a propeller hub;

a blade face and an opposing blade back, wherein one of the blade face and blade back is subjected to a higher pressure from the volume of water than the other surface thereby producing a force to move the marine craft;

a tapered leading edge configured to enter the water first when the propeller is rotating to move the marine craft forward;

an opposing trailing edge that is thicker than the leading edge;

a first geometric feature on the trailing edge of the blade face surface that creates a first fluid pressure peak nearby, producing force to move the marine craft forward; and a second geometric feature on either the blade back or the blade face that is located substantially mid-chord, wherein the second geometric feature creates a nearby second fluid pressure peak thereby producing force to move the marine craft;

wherein the first geometric feature on the trailing edge rises from a local surface of the blade face when traversing the blade face from leading edge to trailing edge; and wherein the trailing edge step feature further comprises at least one region of increasing slope when traversing a surface of the blade from leading edge to trailing edge whereby a fluid pressure peak is created substantially at or near the region of increasing slope during a rotation of the blade in a fluid.

17. The blade of claim 16, further comprising a third geometric feature on the one of the blade back and the blade face that does not include the second geometric feature, wherein third geometric feature creates a nearby third fluid pressure peak thereby producing force to move the marine craft.

* * * * *

UNITED STATES PATENT AND TRADEMARK OFFICE

CERTIFICATE OF CORRECTION

PATENT NO. : 8,696,318 B2
APPLICATION NO. : 12/718703
DATED : April 15, 2014
INVENTOR(S) : Rolla It is certified that error appears in the above-identified patent and that said Letters Patent is hereby corrected as shown below:

In the Specification:

Column 4, line 13: Replace “including a'plurality of” with “including a plurality of”

Column 8, line 5: Replace “10A-K” with “10A-M”

Column 9, line 45: Replace “least one of” with “at least one of”

In the Claims:

Column 10, line 42, Claim 10: Replace “the geometric, feature” with “the geometric feature”

Column 10, line 56, Claim 14: Replace “is a. surface of” with “is a surface of”

Signed and Sealed this
Fifteenth Day of July, 2014

Michelle K. Lee

Michelle K. Lee
*Deputy Director of the United States Patent and Trademark Office*